US005471927A

United States Patent [19]

Frank et al.

[11] Patent Number: 5,471,927

[45] Date of Patent: Dec. 5, 1995

[54] TEMPERATURE CONTROLLED PRINTING PRESS

[75] Inventors: Donald L. Frank, Mesquite; Harry H. Royse, Dallas, both of Tex.

[73] Assignee: Royse Manufacturing Company, Inc., Dallas, Tex.

[21] Appl. No.: 249,389

[22] Filed: May 26, 1994

[51] Int. Cl.[6] ..... B41F 23/04

[52] U.S. Cl. ..... 101/216; 101/141; 101/487

[58] Field of Search ..... 101/182, 212, 101/216, 219, 487, 220, 141, 142, 453, 150, 153; 100/92, 93 R, 93 P, 93 RP

[56] References Cited

U.S. PATENT DOCUMENTS

| | | | |
|---|---|---|---|
| 2,971,460 | 2/1961 | Shindle | 101/487 X |
| 3,584,681 | 6/1971 | Sternberg | 101/250 X |
| 4,183,298 | 1/1980 | Cappel et al. | 101/348 |
| 4,527,473 | 7/1985 | Littleton | 101/220 |
| 4,617,864 | 10/1986 | Niedermaier et al. | 101/219 |
| 4,857,135 | 8/1989 | Copp | 156/580 |
| 4,920,881 | 5/1990 | Tafel | 101/488 |
| 5,048,418 | 9/1991 | Hars et al. | 101/216 X |
| 5,074,213 | 12/1991 | Kurosawa | 101/487 |
| 5,189,960 | 3/1993 | Valentini et al. | 101/487 |

FOREIGN PATENT DOCUMENTS

| | | | |
|---|---|---|---|
| 0101938 | 4/1991 | Japan | 101/487 |

*Primary Examiner*—Chris A. Bennett
*Attorney, Agent, or Firm*—Richards, Medlock & Andrews

[57] ABSTRACT

A printing press (10) is disclosed which incorporates a cooling system for the lubricating oil. The lubricating oil comes into contact with the major heat generating components of the printing press and control of the temperature of the lubricating oil provides an efficient technique for maintaining the printing press temperature at optimal temperature. A printing press (100) is also disclosed which includes water fluid flow through ink rollers (108). A source of cold water (114) can be tapped to supply water to the rollers to cool the rollers and a source of hot water (126) can be tapped to provide heated water to heat the rollers. Fuzzy logic is utilized with heating or cooling about a set point temperature within a given range being performed with the majority of the fluid being bypassed while heating and cooling outside of the predetermined range is achieved by flow of solely heated or cooled water.

12 Claims, 4 Drawing Sheets

TEMPERATURE CONTROLLED PRINTING PRESS

TECHNICAL FIELD OF THE INVENTION

This invention relates to an offset printing press, and particularly to the control of the press temperature.

BACKGROUND OF THE INVENTION

The offset printing press has wide application throughout the printing industry. The printing press generally delivers ink from an ink supply through a series of rollers to a roller having the actual image to be imprinted thereon. This image roller, in turn, transfers the ink in the desired pattern to the material being printed on. Many of these rollers are driven by a gear mechanism, usually from only one side of the press, and other rollers are rotated simply by the frictional engagement between that roller and adjacent rollers. Virtually all rollers are mounted on bearings at the ends of the rollers.

Printing quality depends a great deal upon maintaining uniform conditions in the press. One important condition is the temperature of the press, including the temperature of the ink and of the rollers on which the ink is transferred. In almost all printing presses, the gear side runs hotter than the operator side. In addition, when the press is run after a long period of quiescence, the parts of the press will be at room temperature and must be warmed to operating temperature to provide consistent printing.

In certain presses, a water coolant flow is utilized to cool various portions of the press and attempt to maintain a uniform temperature within the press. However, it has been found that water cooling has not been totally effective at providing a consistent and uniform temperature within the critical components of the press. Therefore, a need exists to better control the temperature of these critical components.

SUMMARY OF THE INVENTION

In accordance with one aspect of the present invention, a printing press is provided which includes a frame mounting a plurality of rollers. A lubricating oil storage tank is used and an oil pump is provided to distribute the lubricating oil to the rollers for lubrication. A heat exchanger is provided with a first side and a second side. The lubricating oil from the oil pump passes through the first side of the heat exchanger. A coolant source is provided which supplies a coolant to the second side of the heat exchanger. A lubricating oil temperature sensor senses the temperature of the lubricating oil or a critical component in the press and a control is provided to control the heat transfer from the lubricating oil to the coolant source to maintain the temperature of the lubricating oil or critical component about a set point.

In accordance with another aspect of the present invention, an offset printing press is provided which includes a frame mounting a plurality of rollers. A temperature sensor, source of coolant and source of heat are provided. A control is used to analyze the temperature sensed by the temperature sensor and permit a first rate of heat transfer to occur between the source of coolant or the source of heat to the press for a first temperature range about a set point and a second, increased rate of heat transfer to occur between the source of coolant or the source of heat when the temperature moves outside the first temperature range.

BRIEF DESCRIPTION OF THE DRAWINGS

A more complete understanding of the invention and its advantages will be apparent from the following detailed description when taken in conjunction with the accompanying drawings in which.

DETAILED DESCRIPTION

Figure 1:
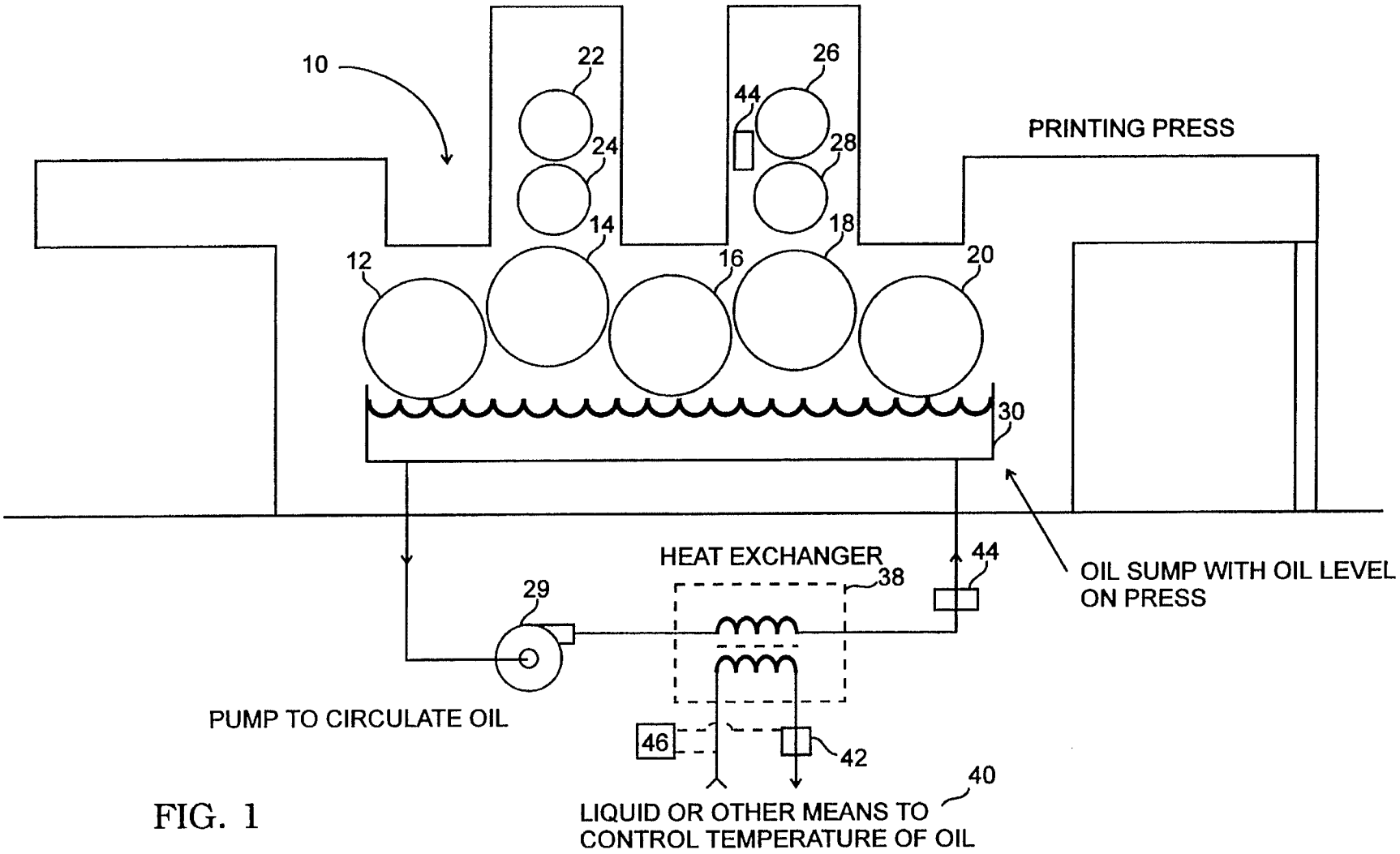
FIG. 1 is an illustrative view of a printing press forming a first embodiment of the present invention.
Figure 2:
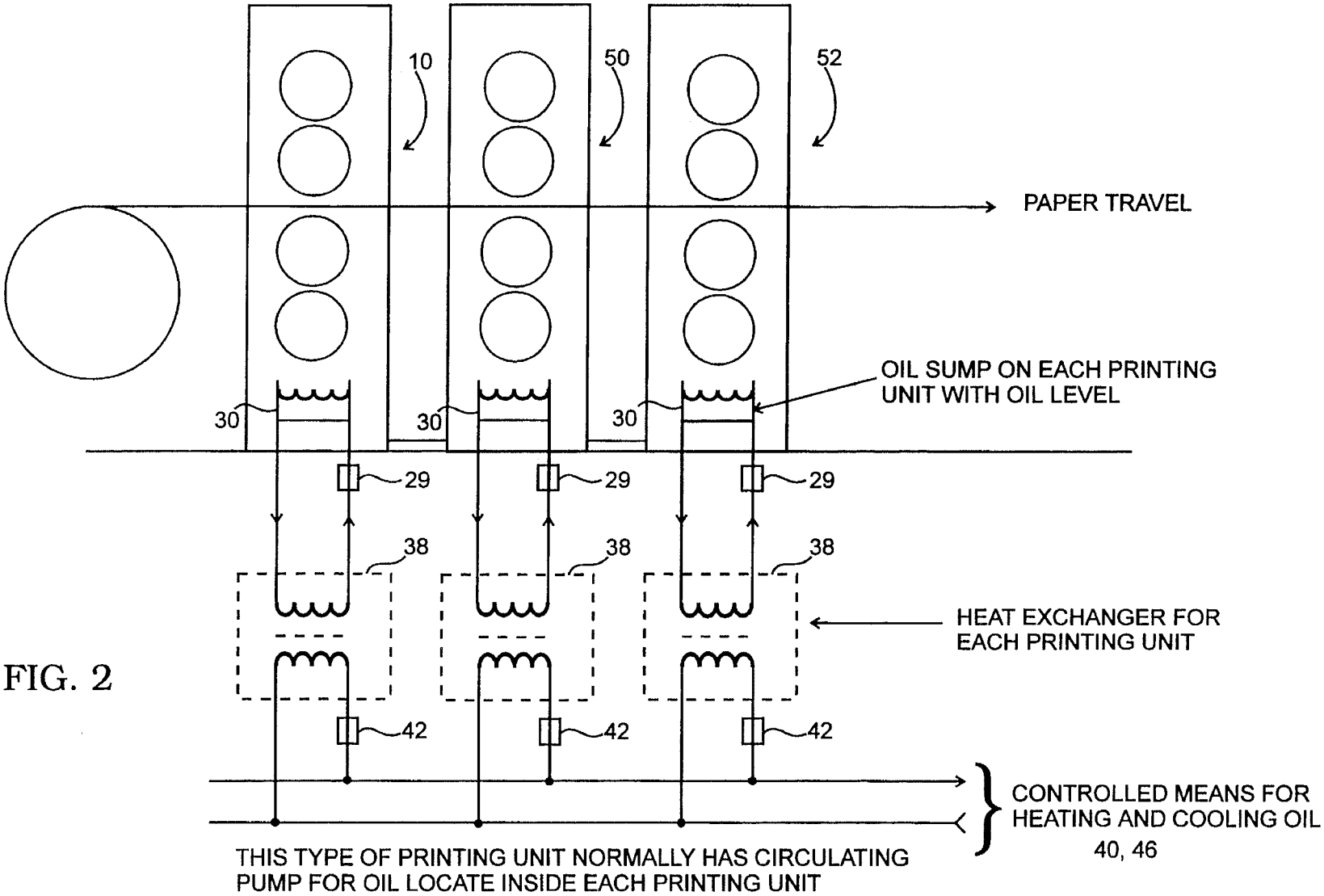
FIG. 2 is an illustrative view of a series of presses incorporating the teachings of the present invention.
Figure 3:
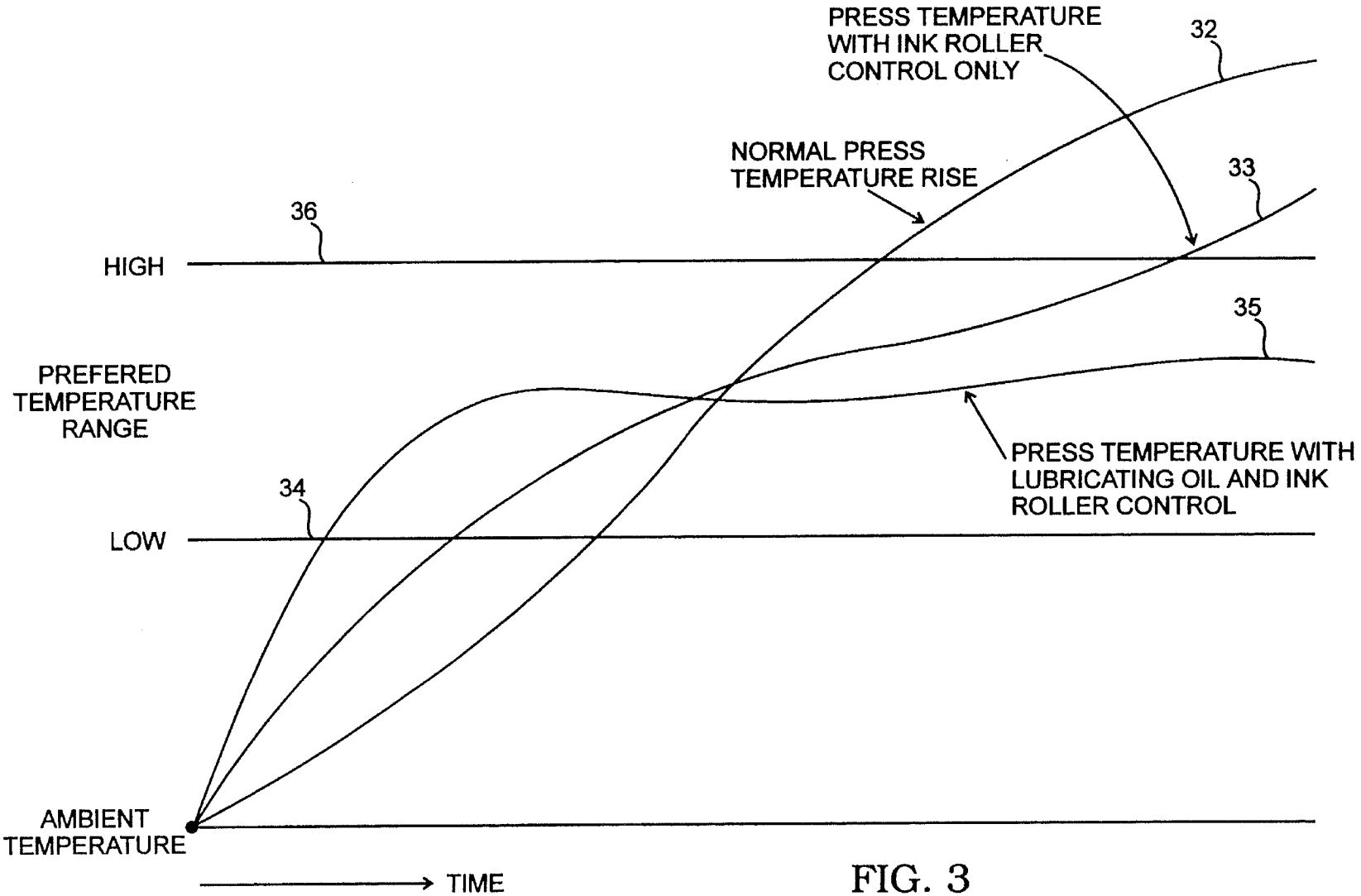
FIG. 3 is a graphical representation of the temperature control of the press of the present invention as compared to conventional presses.

Referring now to FIGS. 1–3, wherein like reference characters designate like or corresponding parts throughout the several views, FIGS. 1–3 illustrate a printing press 10 forming a first embodiment of the present invention. Many of the components of the press are well known, including a series of rollers 12–28 which are rotated to transfer ink from a source of ink to the object being printed. The majority of the rollers are driven by a gear train on one side of the press and each of the rollers are typically supported by ball bearings at the ends of the rollers.

The press 10 is provided with a lubricating system with lubricating oil being circulated from an oil sump 30 to various sites in the press requiring lubrication, such as the ball bearings supporting the rollers and the gear train driving the rollers. The lubricating oil can be under pressure driven by an oil pump 29 or the oil pump 29 can simply lift the lubricating oil to the upper portions of the printing press where the oil will lubricate the components as it drips back to the sump. In the past, a printing press will, over a period of operation, become very hot, for example 120° to 140° F. in the ink train, because of friction forces generated in the printing operation. This is illustrated by line 32 in the graph of FIG. 3 which shows the temperature of the press will rise constantly from the initial room temperature at which the press begins operation to well beyond the preferred temperature range defined by lower limit 34 and upper limit 36, degrading the quality of printing. At such a point, the operator has no choice but to shut down the press to allow the press to cool again into the preferred temperature range.

Even with water cooling of the ink roller, the temperature rise of the printing press is only delayed somewhat, as illustrated by line 33 in FIG. 3. With such cooling, a passage is usually formed through the ink roller(s) and cooling water is passed through this passage from one end of the roller(s) to the other. Such cooling, by its very nature, will create somewhat of a temperature gradient across the roller as the water warms as it passes through the ink roller.

The printing press 10 of the present invention is provided with a mechanism to cool the oil which includes a heat exchanger 38, a source of coolant 40 and a control 42 to control the quantity of heat transfer between the lubricating oil and the coolant supplied from the coolant source 40. As will be explained hereinafter, the goal of the device is to aid in controlling the ink temperature at the point of application to a printing plate. When this goal is achieved, this will aid in the improvement of print quality and lower waste. The transfer of heat from the lubricating oil removes accumulated heat from all the heat generating mechanical parts within the printing press. The source of coolant 40 can be chilled liquid, coolant air, direct freon or other refrigerant. The existing chilled water system in a plant can also be used.

A temperature sensor 44 will be used to measure the temperature of the lubricating oil or of a key component or components in the printing press. The temperature will be analyzed by the control 42 to determine the rate of heat transfer from the lubricating oil to the coolant in the heat exchanger 38 necessary to maintain the temperature of the lubricating oil or critical components at the desired set point temperature. If the temperature sensor 44 senses the lubricating oil temperature and the control 42 thereby controls the oil temperature to a certain specific set point temperature, for example, 100° F., the control would hold the press at a lower operating temperature than would otherwise be encountered, but would not maintain a specific temperature on any part of the press. If the temperature sensor 44 is mounted at a specific point on the press, for example, a bearing hub, portion of the side frame, etc., the control would cool the lubricating oil to maintain the temperature at the specific point at a uniform set point, regardless of the general temperature of the press.

An advantage of the present invention is that the flow of lubricating oil through the printing press is in no way restricted in a significant manner as it passes through the heat exchanger. The heat transfer rate is determined by the rate of flow of the coolant which is controlled by the control 44.

In a modification, a source of heat 46 can also be connected to the heat exchanger 38 which permits the lubricating oil to be heated. The heated lubricating oil then heats the printing press, to allow the printing press to warm to the preferred temperature range more quickly. On any modern press that can produce close register printing, the press crew must rotate the press for some time in the morning before the press is up to temperature for printing. The control 42 would provide heat transfer to the lubricating oil, which would heat the press, to warm it more rapidly. After the press has achieved operating temperature, the control 42 would then cool the lubricating oil as necessary to maintain a constant press temperature. If the oil temperature control 42 is operated around the clock, the lubricating oil would maintain the press at operating temperature through inactive periods and thereby eliminate the warmup period when the press is again activated.

A number of advantages arise by use of the printing press with temperature control. By maintaining a stable temperature on the press bearings, gears, rollers and side frame, changes will be reduced in the register over longer running periods. Control of the lubricating oil temperature, in conjunction with temperature controlled ink rollers cooled by cooling water, will help reduce temperature variation across the press due to the higher temperature on the end of ink rollers. As noted, in almost all printing presses, the gear side runs hotter than the operator side. Control of oil temperature will reduce this difference and help hold closer register over long running periods. Ink roller temperature control systems operate with limited surface contact in the inker. The heat transfer is limited by the number of roller contact points or stripes between mating rollers and the width of the contact point. The width may vary from 1 mm to as much as 15 mm and more. The contact point is usually adjustable by the operator and therefore is not a constant. Control of the lubricating oil temperature provides a much enhanced mechanism for controlling press temperature as the lubricating oil operates within the press infrastructure and makes contact with much greater surface areas and major components such as the roller bearing and drive gears. Areas in direct contact with the lubricating oil would normally not be affected by operator adjustments and so will remain very constant throughout the period of press operation. With the present invention, it should be possible to achieve temperature control as shown by line 35 in FIG. 3.

Maintaining a controlled operating temperature range on the press will cause major components such as bearings and gears to have increased life and will allow those parts to seek and maintain a certain tolerance or fit. This tolerance is maintained over indefinite periods by the cooling of the lubricating oil which will aid in holding color and register in the finished product.

If desired, the cooling and heating capabilities of the lubricating oil can be combined with the existing control for water coolant flow through the ink rollers. Both the zone control for the ink rollers and the lubricating oil temperature control may be contained in one enclosure for each printing unit. This enclosure would have a circulating pump for the water through the ink rollers, control circuits and mechanisms for controlling the hot and cold water flow, control circuits and mechanisms for controlling the temperature of the lubricating oil all controlled to provide a desired operating temperature.

With reference to FIG. 2, the advantages of the present invention can be seen to apply to a zone control system to maintain the temperature of a number of printing units including printing units 10, 50 and 52. A multi-color press is made up of several single color units. Each printing unit is provided with an oil sump 30 and with a heat exchanger 38. A single source of coolant 40 and source of heat 46 can be utilized but individual controls 42 will be provided for each of the printing units. The zone control system will include an individual circulation pump 29 for each printing unit. A series of check valves and solenoid valves permit the controllers 42 to provide the proper cooling or heating temperature to the lubricating oil in the particular printing unit.

Figure 4:
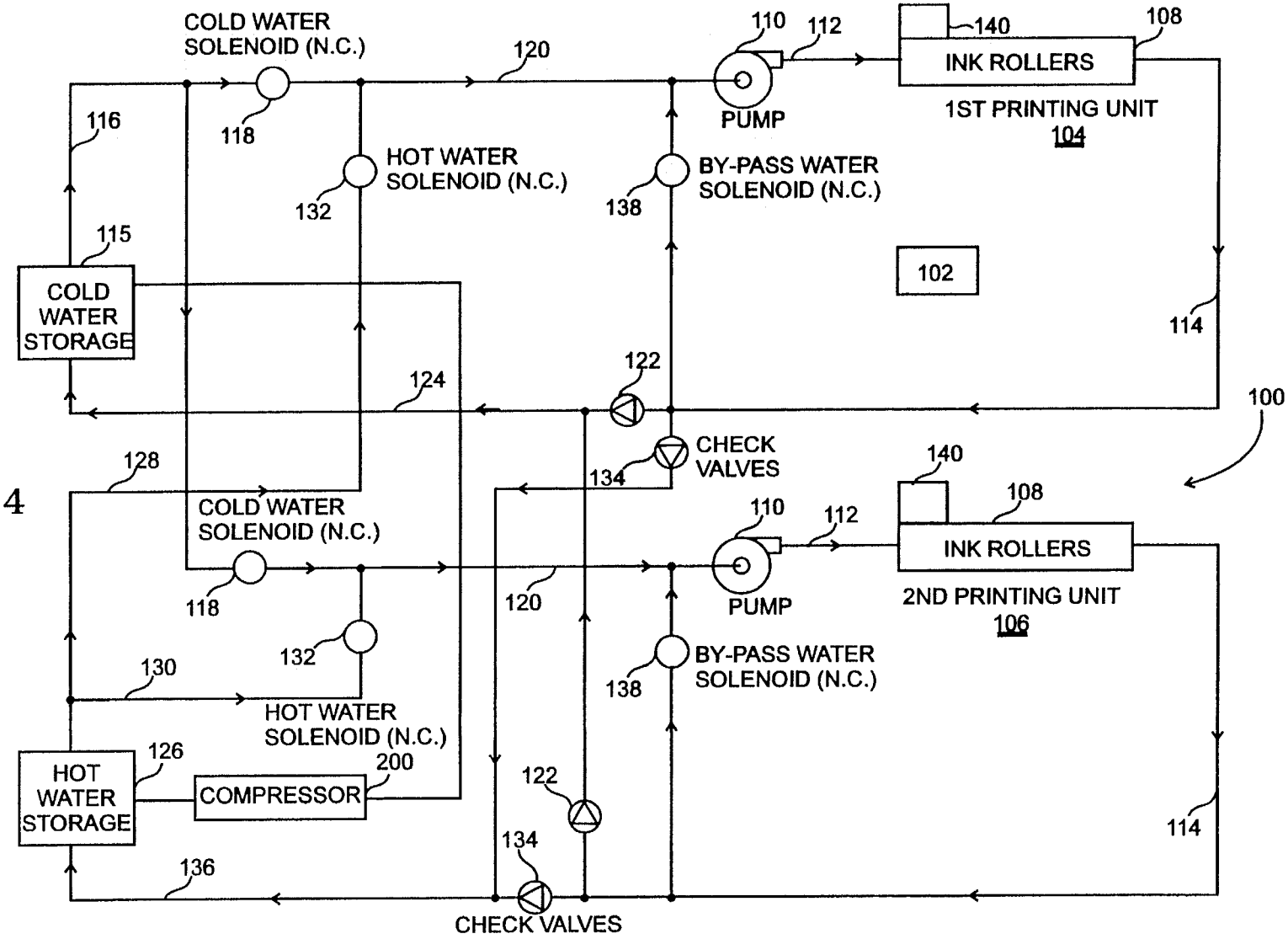
FIG. 4 is an illustrative view of a printing press forming a second embodiment of the present invention for controlling the printing press temperature by water flow.

With reference now to FIG. 4, a printing press 100 forming a second embodiment of the present invention will be described. A control unit 102 within the printing press is designed to use a form of fuzzy logic to maintain the temperature of the printing press within a narrow temperature range. Basically, the control will provide heat transfer to or from the printing press at a first lower rate if the temperature of the press varies from a set point by only a certain number of degrees. If the temperature of the printing press lies outside that temperature range, i.e. is too hot or is too cold, the heat transfer will be at a much higher, second rate to either warm up the machine quickly or provide extra cooling to cool the machine.

With reference to FIG. 4, the invention can be seen to be applied to a printing press with two separate printing units, a first printing unit 104 and a second printing unit 106. Each of the printing units has a series of ink rollers 108 whose temperature must be carefully controlled. To do so, each of the ink rollers has a coolant passage therethrough. A pump 110 pumps the coolant fluid through line 112 into the ink rollers to cool the rollers with the coolant being removed through lines 114. If the ink rollers are maintaining the desired temperature, the water passing through the rollers is simply recirculated without the addition or removal of heat.

A bypass water solenoid valve 138 is placed between line 114 and line 120 entering each pump which permits recirculation of the water from the rollers back into the inlet of the pump.

If the fluid provided to the ink rollers is designed to cool the ink rollers, at least some of the fluid flowing through the ink rollers is provided from a cold water storage 115 through line 116, cold water solenoid valve 118 and line 120 to the inlet of the pump 110. The fluid is returned to the cold water storage through check valves 122 and line 124.

If the fluid flowing through an ink roller is to heat the ink roller, at least some of the fluid flowing through the ink rollers is taken from a hot water storage 126 through lines 128 and 130 to hot water solenoid valves 132 and then to lines 120 into the inlet of the pumps 110. The fluid returns from the ink rollers through check valves 134 and line 136.

A temperature sensor 140 is mounted at each set of ink rollers to measure the temperature. The control 102 utilizes the information from the temperature sensor and, if the temperature of the printing unit changes from the set point temperature within a predetermined range, for example plus or minus 1° F., the control will then open the appropriate solenoid valve 118 or 132 to cool or heat, respectively, the ink rollers to control the temperature. During that period, the bypass solenoid valve 138 is maintained open and the bypass water is mixed with the hot or cold water at a predetermined ratio, for example 2.8:1.

Should the temperature of the printing units continue to drift away from the set point, the control 102 would be activated to shut the bypass solenoid valves 138 so that only cooled water or heated water is provided to the printing press. For example, the control could be operated to activate this increased heat transfer mechanism if the drift away from the set point exceeds plus or minus 4° F. In addition to supplying purely cool or hot water, the rate of flow is increased due to the fixed capacity of the pumps 110. This increased heat transfer will drive the temperature of the printing back toward the set point more rapidly. When the temperature is within a certain range of the set point, for example 2° F., the bypass solenoid valve will again be opened and the system will be returned to the normal operation state.

During startup of the press, the temperature will be quite a bit lower than the set points of the individual printing units. During this period, all bypass valves would be closed and only hot water would be used to raise the temperature of the press units to operating range. If desired, a heater/chiller unit can be used to produce both hot and cold water during this period. The hot water would be used to heat the press and the cold water is stored and used once the press reaches operating temperature for cooling the press.

In a typical compressor operated cooling system, both hot and cold water can be produced simultaneously. The compressor generates heat and this heat can be transferred to water in the hot water storage. The chilling coil can be used to chill the water in the cold water storage. The compressor operation is preferably controlled by the temperature of the chilled water storage. The temperature would preferably be set to 45° F. to 50° F. and when that temperature is achieved the compressor in the cooling plant is turned off. If the temperature of the hot water source is below the necessary storage temperature, auxiliary electric heaters can be turned on in order to maintain minimum temperature in the hot water storage. An efficiency is achieved by not operating the compressor and resistance heaters at the same time, thereby reducing the electric power used to maintain system temperature.

The printing press 100 preferably uses two different temperature sensors. One sensor is a built-in water temperature sensor. The other sensor will be an infrared sensor or other type of sensor located on the printing unit and sensing the inker and/or plate temperature. Preferably, the operator will be able to select either the infrared sensor or water control sensor independently for each printing unit at the operator's control station. Water temperature sensors will typically be used when the press is not running and the infrared sensors may or may not be used when the press is running.

If desired, a switching circuit can be located in the control unit to switch from water control sensing to infrared sensing as the press becomes operational.

The printing press illustrated in FIG. 4 provides isolation of the temperature control of the individual printing units. For example, printing unit 104 may be operating at 80° F. and printing unit 106 at 95° F. The first printing unit 104 may require cold water at 50° F. to enter the pump 110 associated therewith, returning 80° F. water through the check valve 122 associated with the unit. Should the second printing unit 106 demand hot water, 110° F. water could come from the hot water storage and be allowed to enter the pump 110 associated with the second printing unit 106 and the cooler water, perhaps at 95° F., is allowed to return to the hot water storage through the check valve 134 associated with the second printing unit. The circulation flows completely separated between the two printing units.

If desired, the temperature change can be measured between the inlet and outlet of the cold and hot water storage.

The fact that there is no mixing of common return water between printing units will allow the press to produce a much greater temperature difference between units than if there were a common return for mixing of the water. With a cold water storage temperature of 50° F. and a hot water storage temperature of 100° F., one could expect to be able to hold a difference of at least 40° F. between printing units. By storing hot water in the hot water storage, the response time to a change in temperature on the printing press is much shorter since the system does not need to wait for a resistance heater to warm up.

Preferably, the heater/chiller unit will have a number of safety indicators. There will be indicators for the high pressure and low pressure switches of each compressor, also an indicator for the thermal disconnect on each compressor. A flow switch is connected to each of the hot and cold water circulation pumps. There are indicators for the thermal disconnect on both pumps and the resistance heaters. A fault in any of these items will generate an indicator signal or a blinking light at the control unit and the operator's control station. Should there be a fault in the control unit, there are indicators for thermal disconnects on each pump in the unit. A fault in any of these items will generate an indicator signal blinking light at the heater/chiller unit, the control unit and the operator's control station.

The volume of water flow in each of the inking systems is approximately 5 to 8 gallons. This amount of water is being recirculated constantly by pumps 110 at a rate of approximately 9 gallons per minute. Since each unit is isolated from the others, only the 5 to 8 gallons of water will be affected by the addition of hot or cold water. Hot or cold water enters the system at a rate of approximately 2.5 gallons per minute, therefore a rapid change of temperature can be made.

A main disconnect switch will be provided on the heater/chiller unit. To start the unit, the operator will need to turn on the disconnect switch and then push the pump's on button switch. This action starts the hot and cold water pumps. The compressors are interlocked to the pumps and thereafter will begin to generate hot and cold water.

There is also a main disconnect switch on the control unit. To start the unit, the operator will need to turn on the disconnect switch and then push on the push-button switch of the pumps. This action starts the flow of water to the printing units. The main disconnect will also supply power to the power supply and the temperature controllers in the operator's control station.

Although several embodiments of the present invention have been illustrated in the accompanying drawings and described in the foregoing detailed description, it will be understood that the invention is not limited to the embodiments disclosed, but is capable of numerous rearrangements, modifications and substitutions of parts and elements without departing from the scope and spirit of the invention.

We claim:

1. A printing press, comprising:

a frame mounting a plurality of rollers, the rollers being rotated by meshing gears in a gear train, the gear train being lubricated by lubricating oil;

a lubricating oil storage tank;

an oil pump to distribute the lubricating oil to the gear train for lubrication;

a heat exchanger for cooling the oil;

a coolant flowing through selected ones of said plurality of rollers to cool the rollers;

a temperature sensor on the press; and a control to pass a selected quantity of the coolant through the heat exchanger to cool the lubricating oil and provide better overall control of the printing press temperature with less temperature variation across the printing press than possible with the coolant flow alone.

2. The printing press of claim 1 wherein the coolant is water, the rollers having a first end and a second end, the coolant flowing through the rollers from the first end to the second end creating a temperature differential between the first and second ends of the rollers, the control cooling the oil to reduce the temperature differential.

3. A printing press, comprising:

a frame mounting a plurality of rollers, each of said rollers having a gear thereon, the gears meshed one with the other to form a gear train, lubricating oil lubricating the gear train;

a lubricating oil storage tank;

an oil pump to distribute the lubricating oil to the rollers for lubrication at a rate determined by the lubricating requirements of the gear train;

a heat exchanger having a first flow side and a second flow side;

a coolant source supplying a cooled fluid to the second side of the heat exchanger;

a temperature sensor on the press;

a control to control heat transfer from the lubricating oil flowing through the first flow side of the heat exchanger to the coolant fluid flowing through the second side of the heat exchanger.

4. The printing press of claim 3 wherein the temperature sensor measures the temperature of the lubricating oil, the control maintaining the temperature of the lubricating at a set point temperature.

5. The printing press of claim 3 wherein the temperature sensor senses the temperature of a component within the printing press, the control controlling the heat transfer from lubricating oil to the coolant fluid to maintain the temperature of the component at a set point temperature.

6. The printing press of claim 3 further comprising a heated source to supply a heated fluid to the second side of the heat exchanger, the control controlling heat transfer from the hot fluid to the lubricating oil to maintain temperature of the lubricating oil about a set point temperature.

7. A dry offset printing press, comprising:

a frame mounting a plurality of rollers;

a temperature sensor;

a source of coolant fluid operably connected to the plurality of rollers for cooling the plurality of rollers;

a source of heated fluid operably connected to the plurality of rollers for heating the plurality of rollers;

a control analyzing the temperature sensed by the temperature sensor and permitting a first rate of heat transfer to occur between the coolant fluid or the heated fluid and the press for a first temperature range about a set point temperature and a second rate of heat transfer to occur between the coolant liquid or the heated liquid and the press when the temperature moves outside the first temperature range.

8. The printing press of claim 7 further comprising a pump for pumping fluid through said rollers.

9. The printing press of claim 7 where in the control bypasses flow from the rollers at the first rate of heat transfer.

10. The printing press of claim 7 wherein the temperature sensor is a water temperature sensor.

11. The printing press of claim 7 where in the temperature sensor is an infrared sensor.

12. The printing press of claim 7 further including a compressor unit, heat from the compressor providing heat to the source of heated fluid and cooling the coolant fluid.

* * * * *